United States Patent [19]

Breckner et al.

[11] 3,976,343

[45] Aug. 24, 1976

[54] DRAWER LOCKING MECHANISM

[75] Inventors: Gerald Breckner, McDonald; Charles R. Donahue, Youngstown; C. Herbert Hage, Youngstown; Philip J. Williams, Youngstown, all of Ohio

[73] Assignee: GF Business Equipment, Inc., Youngstown, Ohio

[22] Filed: Feb. 11, 1975

[21] Appl. No.: 548,920

[52] U.S. Cl. ..... 312/219; 70/85; 292/DIG. 14

[51] Int. Cl.[2] ..... E05B 65/46

[58] Field of Search ..... 70/85, 86; 292/DIG. 18, 292/40, 161, 188, 29, 46, 52, DIG. 14; 312/215–217, 219

[56] References Cited

UNITED STATES PATENTS

| | | | |
|---|---|---|---|
| 691,756 | 1/1902 | Flesher | 292/DIG. 14 |
| 1,178,724 | 4/1916 | Hunter | 70/85 |
| 1,606,178 | 11/1926 | Rand et al. | 312/219 |
| 2,202,088 | 5/1940 | Clark | 312/219 X |
| 2,793,927 | 5/1957 | Reitzel | 312/219 |
| 3,331,644 | 7/1967 | Kafferlin | 312/216 X |
| 3,764,190 | 10/1973 | Anderson | 312/219 X |
| 3,774,985 | 11/1973 | Chovanec et al. | 312/217 |

*Primary Examiner*—Paul R. Gilliam
*Assistant Examiner*—C. F. Pietruszka
*Attorney, Agent, or Firm*—Emory L. Groff, Jr.

[57] ABSTRACT

A locking mechanism for drawers in an article of furniture includes a unitary lock transfer rod fully disposed within the furniture top and provided with a plurality of axially spaced crank portions. Only those crank portions associated with drawer columns are attached to individual vertical lock bars each having one or more resilient lock dogs thereon whereby, subsequent arcuate displacement of any one of the crank portions is translated as a concurrent displacement of all crank portions and the attached lock bars to move the lock dogs into and out of engagement with striker means carried by the drawers.

8 Claims, 11 Drawing Figures

DRAWER LOCKING MECHANISM

This invention relates generally to office appliances, and more particularly, to an improved drawer locking mechanism for desks and similar articles of office furniture.

Locking arrangements are generally well known wherein a lock device, operable exteriorly of an article of furniture, regulates an interiorly mounted locking mechanism acting upon a plurality of drawers contained in the furniture article. An example of an earlier structure of this type will be found in the U.S. Pat. No. 2,793,927 issued to Reitzel, May 28, 1957, and which is assigned to the same assignee as the instant invention. The structure of the referenced patent is specifically adapted for regulating a pair of lock bars as mounted in a two-pedestal desk and is actuated by means of a key lock mounted in a master drawer disposed between the two pedestals and above a knee hole. Operation of the lock manipulates the medial portion of a rocker shaft having its distal members engageable with two lock bars within the pedestals. The adaptability of the Reitzel construction is somewhat limited as it requires the provision of a center drawer, or at least a center dummy panel for the key lock mechanism and the disclosed rocker shaft is operable only in a situation involving a two-pedestal article of furniture.

By the present invention an improved arrangement is provided wherein the entire lock bar actuating mechanism is carried by the office furniture top and a single such mechanism may be used to provide a drawer lock bar actuating assembly for articles of furniture having various dimensions and containing various numbers of drawer pedestals. The above is achieved by the provision of a single lock transfer rod containing a plurality of crank portions axially spaced apart from one another a distance corresponding to the standard spacing between drawer pedestals and which may be readily and economically mounted within the top of an article of office furniture and to which a varied number of drawer lock bars may be attached depending upon the particular configuration of the article of furniture and without any modification of the transfer rod. A plunger type lock assembly carried by an edge of the furniture top cooperates with one of the crank portions to provide a pre-determined arcuate displacement of the lock transfer rod and all of the other crank portions so that the selective number of lock bars connected to any of the crank portions are operated to lock or unlock the associated drawers.

The present invention further offers an improved drawer locking mechanism as regulated by operation of the drawer lock bars. In the referenced earlier patent, each drawer is locked by means of a displaceable lock dog carried by the side of the drawer and which is adapted to cooperate with a vertically displaceable striker mounted upon the lock bar. Such an arrangement presents an unsightly appearance when the drawers are withdrawn and likewise presents a hazard by snagging of clothing upon the exposed lock dog which is also subjected to accumulation of dirt. The present invention, on the other hand, includes a unique arrangement of the mounting of the lock dogs upon the lock bar itself, and which cooperate respectively with a simple striker member carried by each drawer side.

Accordingly, one of the primary objects of the present invention is to provide an improved drawer locking mechanism comprising a lock transfer rod having a plurality of crank portions, suitable in number to serve a maximum number of lock bars usually accommodated in a particular size and style of office furniture and wherein only those crank portions overlying drawer pedestals in any specific installation are utilized.

A further object of the present invention is to provide an improved drawer locking mechanism including a lock transfer rod having a plurality of crank portions, one of which is engaged by a key lock assembly while any number of the remaining crank portions may be selectively utilized to regulate the operation of a corresponding number of lock bars associated with drawers.

Still another object of the present invention is to provide an improved drawer locking mechanism including a lock transfer rod having a plurality of crank portions, at least one of which is arcuately displaceable by means of a plunger lock and wherein both the plunger lock and lock transfer rod are carried by the top of the furniture article.

Another object of the present invention is to provide an improved drawer locking mechanism including a pivotal lock transfer rod having a plurality of crank portions, at least one of which is engageable with a vertically displaceable lock bar, the latter carrying one or more resilient lock dogs normally serving to block the withdrawal of an adjacent drawer.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which.

Similar reference characters designate corresponding parts throughout the several figures of the drawings.

Figure 1:
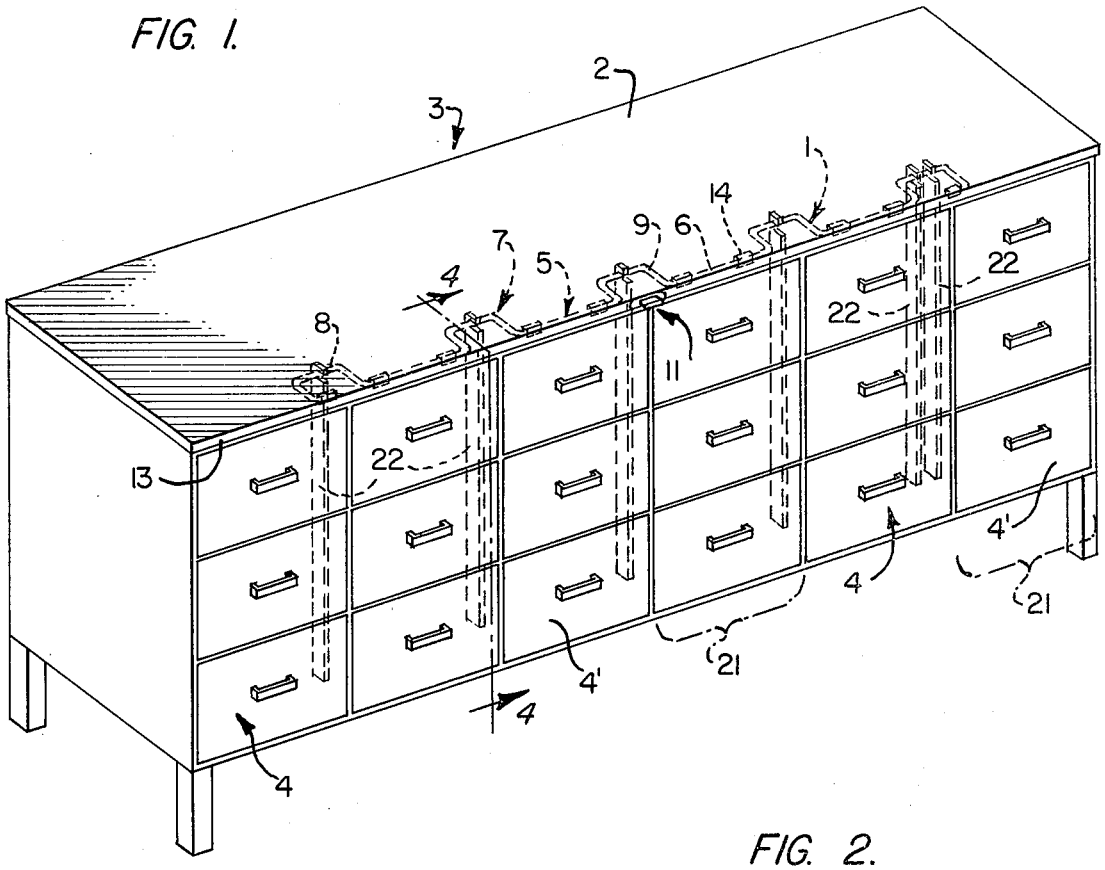
FIG. 1 is a perspective view of an article of furniture provided with the drawer locking mechanism of the present invention.

Referring now to the drawings, particularly FIG. 1, the present invention will be seen to relate to a drawer locking mechanism, generally designated 1, and which is adapted to be mounted within the top 2 of any appropriate article of furniture 3. Although a console is illustrated in this view, it will be appreciated that the drawer locking mechanism 1 may be readily utilized within the top 2 associated with any one of several other types of office furniture such as a single pedestal desk, a double pedestal desk or a console having less than the illustrated number of columns of drawers 4. In fact, the principal advantage of the present drawer locking mechanism is its adaptability for use in any of the various above described articles of furniture without any modification of the principal components thereof.

Figure 3:
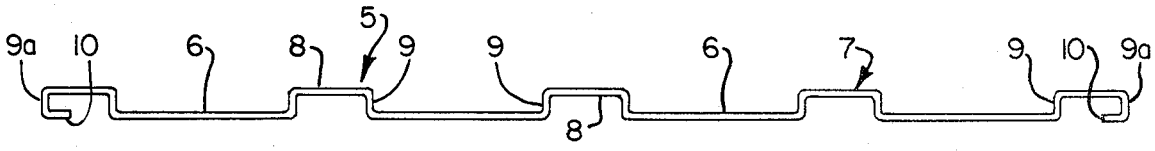
FIG. 3 is a top plan view of a lock transfer rod according to the present invention.
Figure 4:
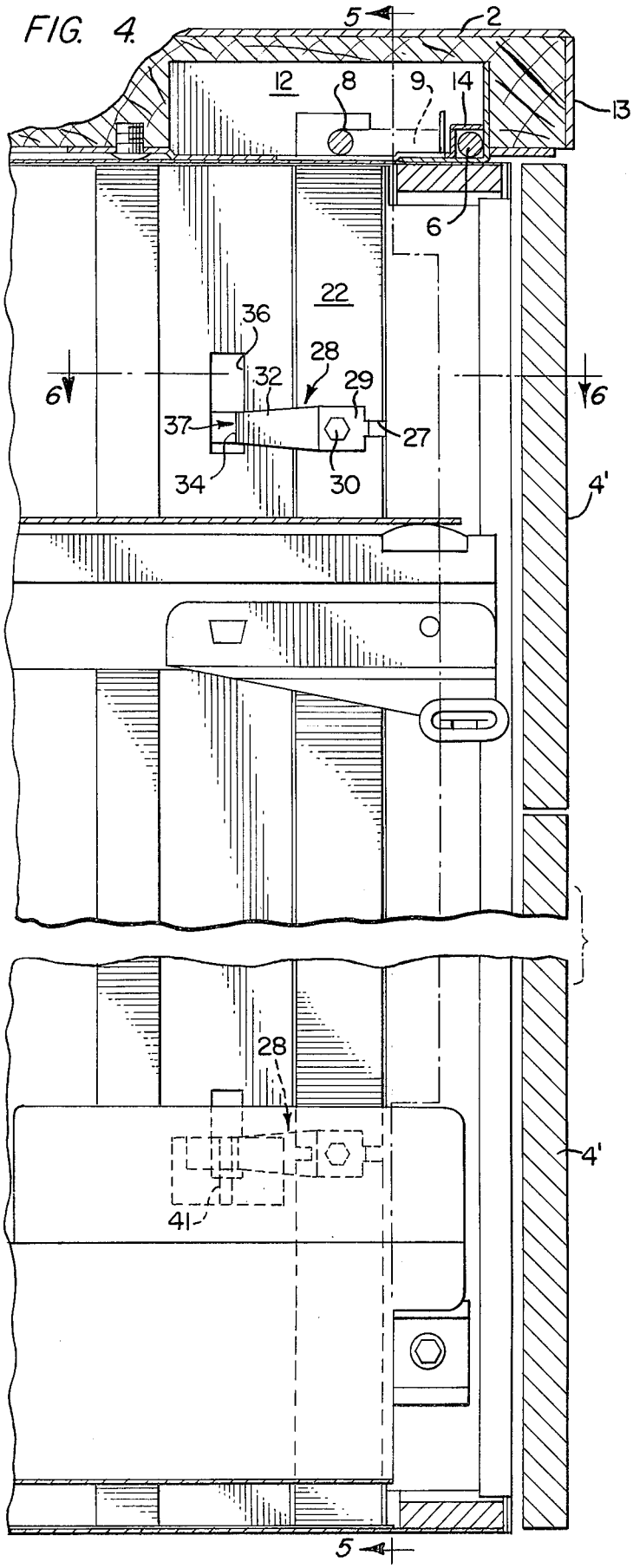
FIG. 4 is a fragmentary vertical sectional view, taken along the line 4—4 of FIG. 1, and illustrates a lock bar provided with two lock dogs thereon.
Figure 5:
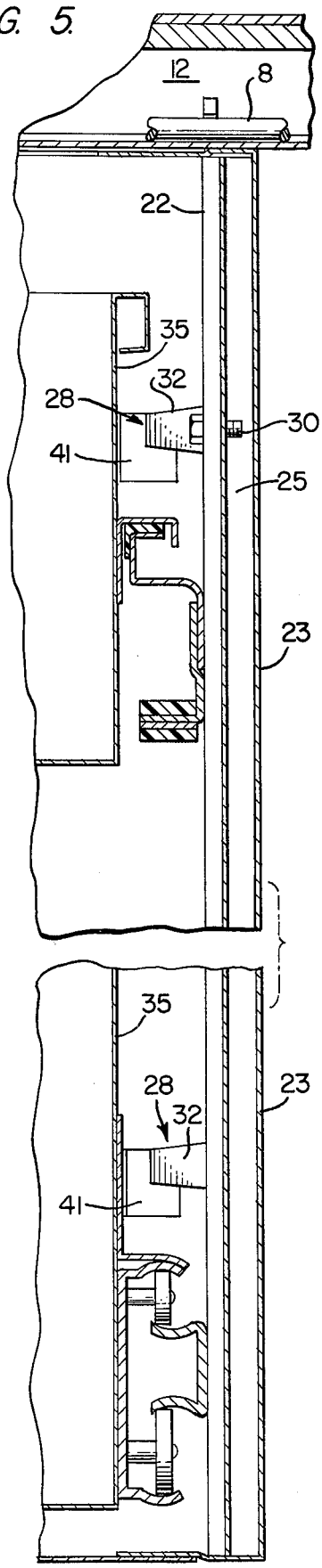
FIG. 5 is a vertical sectional view, taken along the line 5—5 of FIG. 4.

The primary element of the drawer locking mechanism 1 may be considered to be the lock transfer rod, generally designated 5, an example of which is shown in its entirety in FIGS. 1 and 3 of the drawings. This lock transfer rod 5 contains a plurality of axial portions 6, each of which is bounded at both ends by a crank portion 7, the latter including an eccentric arm 8 each connected at its distal portion by means of a radial arm 9 joined in turn to the end of an adjacent axial portion 6. The endmost radial arms **9*a* are joined to an inturned axial arm 10, which arms 10 are axially aligned with the axial portions 6 previously described. The length of the axial portions 6 are preferably equal as is the length of the plurality of eccentric arms 8** for reasons which will become apparent immediately hereinafter.

By selecting the length of the axial portions 6 so as to position the center of each adjacent pairs of crank portions 7 at a distance from one another which is equal to the standard distance between two adjacent drawer pedestals or columns, it will be appreciated that when the lock transfer rod 5 is subsequently installed within the top 2 of an article of furniture with any one of the crank portions 7 properly positioned above the lateral edge of a pedestal, then all of the remaining crank portions 7 will be automatically properly positioned above the similar points of any other drawer pedestals which may be associated with the particular furniture top 2 of the installation. This does not mean that each of the crank portions 7 of any particular single lock transfer rod 5 will be associated with a drawer pedestal and utilized to actuate a drawer lock bar but rather means that the thus-equipped furniture top 2 may subsequently be combined with any one of various sub-structure configurations from a single drawer pedestal on up to a plurality of drawer pedestals, according to the capacity of the lock transfer rod 5.

Figure 2:
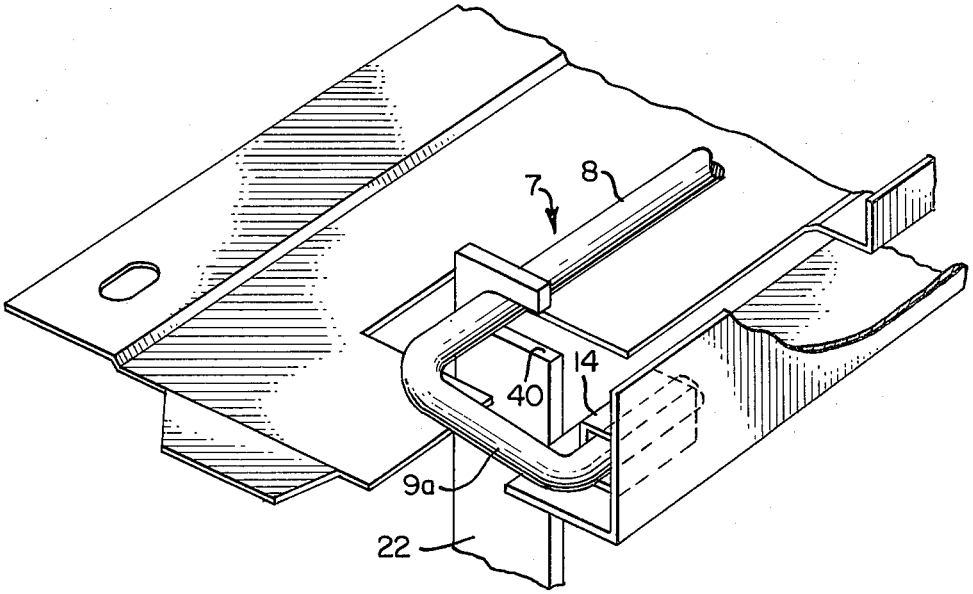
FIG. 2 is an enlarged fragmentary perspective view of one end of the lock transfer rod of the present invention and illustrates its engagement by a lock bar.
Figure 7:
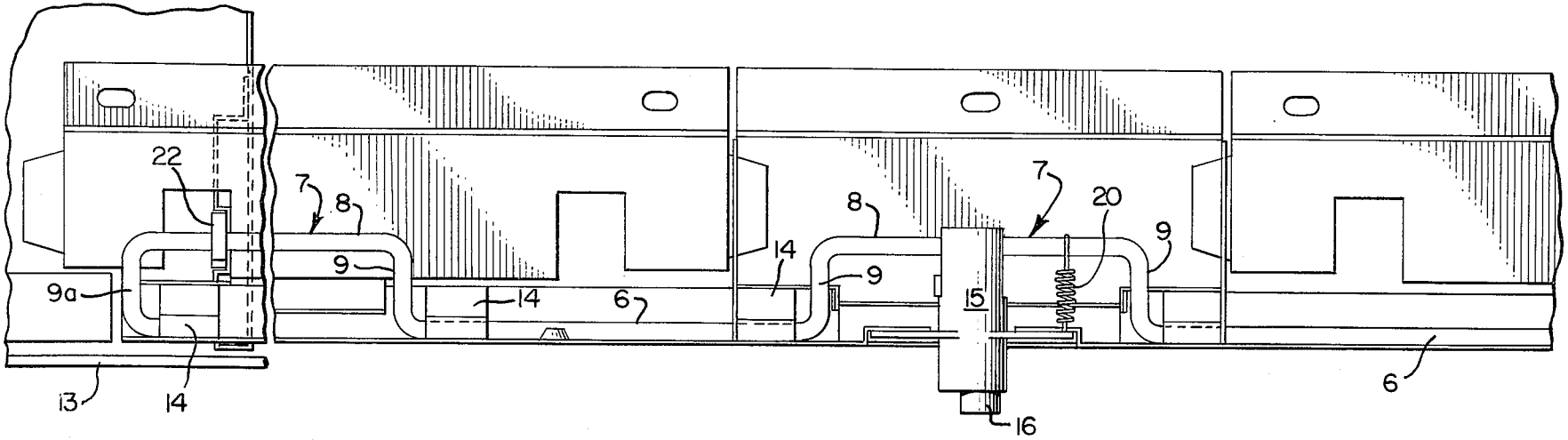
FIG. 7 is a horizontal sectional view showing a portion of a lock transfer rod and the lock assembly for actuating same as mounted within the top of an article of furniture.

The installation of the lock transfer rod and an appropriate lock assembly 11 within the confines of a furniture top 2 is achieved in a relatively simple manner. an appropriate recess 12 is provided within the confines of the top 2 below its uppermost surface and immediately behind the top edge 13 along the user's side of the furniture article. The crank portions 7 are positioned as shown in FIGS. 1, 2 and 7, in a direction away from the top edge 13, and the lock transfer rod 5 is attached to the furniture top 2 by means of a plurality of bearing clips 14 engaging selected portions of the axial portions 6 and the inturned axial arms 10, such that any subsequent arcuate displacement of the crank portions 7 will be about the central axis as provided by the axial portions 6 and axial arms 10. An appropriate lock assembly 11 is mounted through the edge 13 of the top 2 at a point opposite a selected one of the crank portions 7 and includes a lock casing 15 fixedly disposed relative the top 2 and housing a reciprocating plunger mechanism 16 of suitable construction. Such locks are well known and include a key access in the exposed face of the plunger 16 such that when the lock is in the secured position with the plunger fully depressed, application of the key releases the plunger which then returns to the outwardly extended position.

Figure 9:
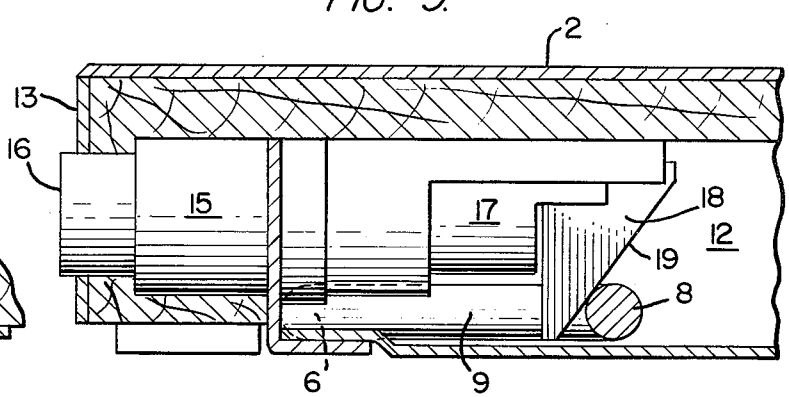
FIG. 9 is a view similar to FIG. 8 and illustrates the lock assembly as it appears when in the locked position.
Figure 8:
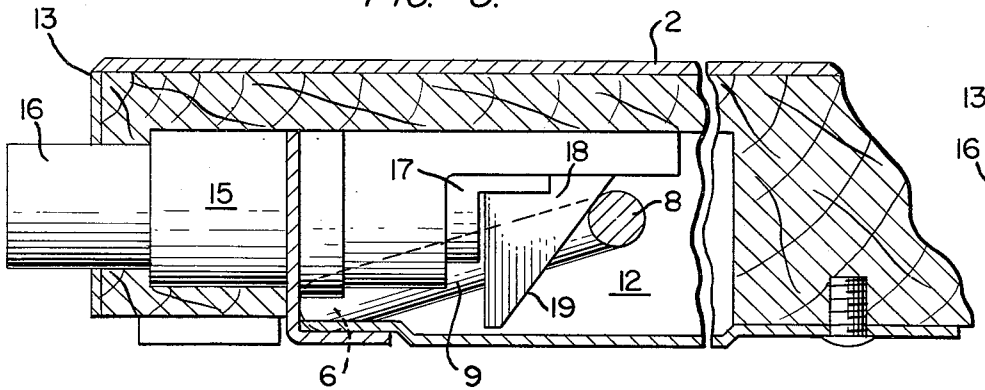
FIG. 8 is a vertical sectional view through a desk top and illustrates the lock assembly as it appears when in the unlocked condition.

The alternate positions of the lock assembly 11 are most clearly illustrated in FIGS. 8 and 9 of the drawings wherein it will be seen that the plunger 16 includes an extension 17 provided with a cam 18 on its innermost portion, which cam presents a rearwardly directed inclined face 19 on its undersurface. The cam face 19 at all times overlies a portion of one of the eccentric arms 8 of the lock transfer rod 5. When in the released condition the lock cam face 19 engages the transfer rod eccentric arms 8 along its upper portion as shown in FIG. 8, but when depressed as in FIG. 9, the rectilinear displacement of the cam 18 is translated as a vertical and downwardly arcuate displacement of the eccentric arm 8 as this arm is engaged by the lower portion of the cam face 19. An important point to realize during the alternate displacement of the eccentric arm 8 is that all of the remaining crank portions 7 of the lock transfer rod 5 are similarly displaced in a concurrent manner to move the other respective eccentric arms 8 from the elevated or unlocked position to the lowered or locked position. The application of a suitable key (not shown) to the plunger 16 will be understood to automatically cause the rectilinear displacement of the cam 18 from the position of FIG. 9 to that as shown in FIG. 8 of the drawings, yet positive means in the form of an extension spring 20 is provided as shown in FIG. 7 to positively and progressively elevate the eccentric arm 8 from the lowered position to the elevated position as the lock cam 18 is retracted.

Associated with each pedestal or drawer column 21 of the article of furniture is a lock bar, generally designated 22, and which is mounted for vertical displacement adjacent either a side wall or intermediate partition 23 of the article of furniture. A preferred mounting for the lock bars 22 is shown most clearly in FIGS. 6, 10 and 11, wherein it will be seen that a lock bar mounting plate 24 is suitably attached adjacent its respective partition 23 to provide a cavity 25 therebetween with the mounting plate 24 including a vertical channel 26 constructed to receive the lock bar 22 in a close sliding manner. A plurality of cut-outs 27 are provided throughout the vertical extent of each lock bar 22 and are spaced apart from one another a distance corresponding to the standard spacing between vertically stacked drawers as provided in any one console such that selected cut-outs are utilized according to the number of drawers and the drawer heights intended to be serviced by any one lock bar 22. Associated with each selected cut-out 27 is a lock dog, generally designated 28, and comprising a unitary resilient member having a tab 29 secured to the lock bar 22 by means of a fastener 30 such that the tang 31 depending from the edge of the tab 29 is disposed within the lock bar cut-out 27. This arrangement will thus serve to preclude pivotal displacement of the lock dog 28 about its fastener 30. Projecting from the opposite edge of the tab 29 is a ramp 32 which will be seen to extend a substantial distance into the drawer opening 33 juxtaposed the mounting plate 24. The outer end of the ramp 32 is joined to a face member 34 disposed substantially normal to the direction of rectilinear displacement of the drawer side wall 35. As will be seen most clearly in FIG. 10 of the drawings, the inner end of the face member 34 is disposed through an aperture 36 formed in the mounting plate 24 and terminates in a foot, generally designated 37, and fully disposed within the confines of the cavity 25 at all times. The foot 37 includes a heel 38 extending to one side of the face member 34 and a toe 39 disposed on the opposite side of the face member 34.

Figure 6:
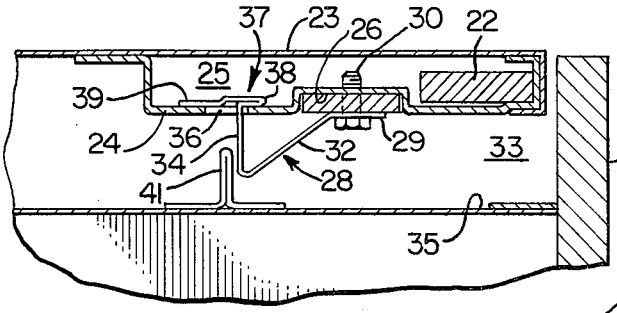
FIG. 6 is a horizontal sectional view, taken along the line 6—6 of FIG. 4.
Figure 10:
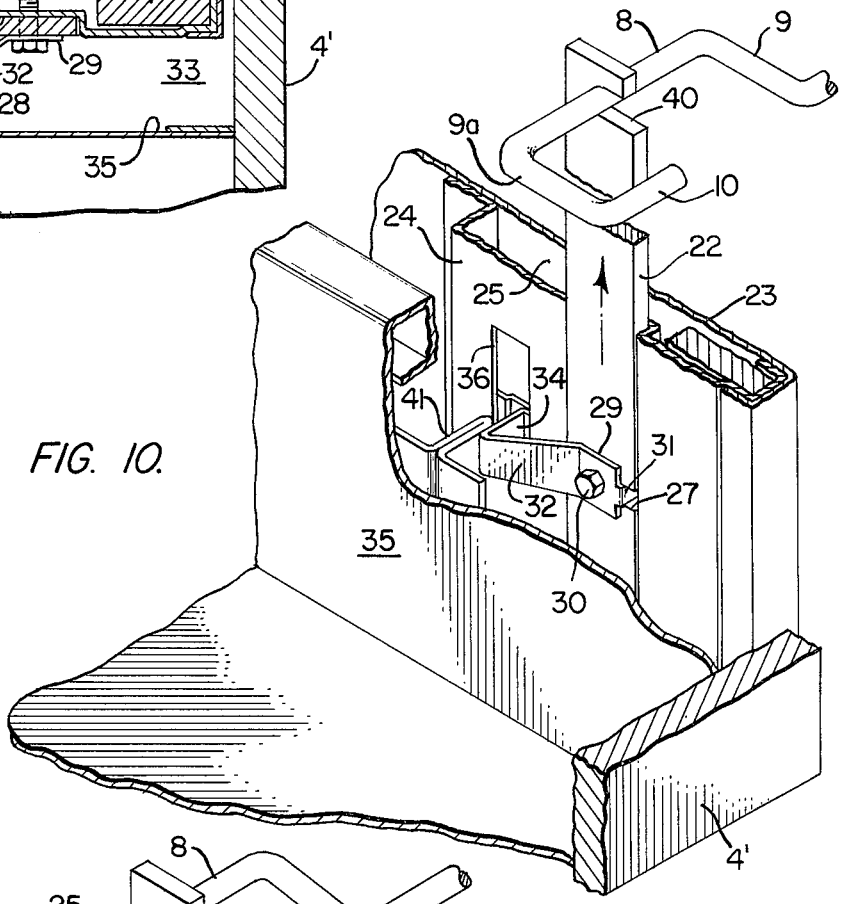
FIG. 10 is a fragmentary perspective view illustrating a lock bar and its associated structure as it appears when in the locked position.
Figure 11:
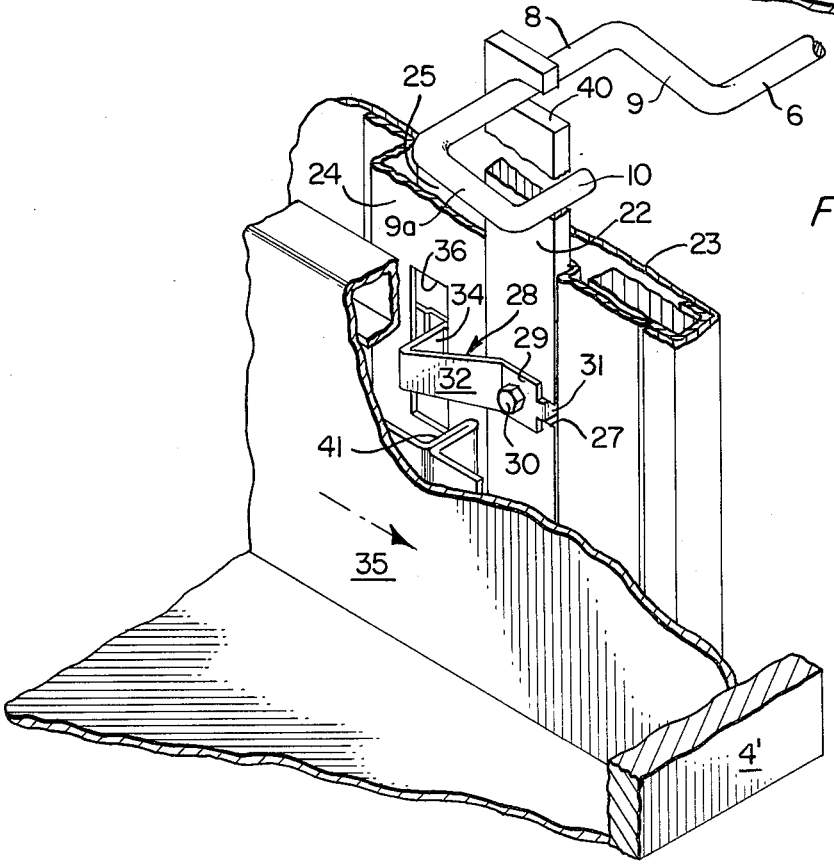
FIG. 11 is a view similar to FIG. 10 and illustrates the lock bar and its associated structure as it appears when in the unlocked position.

The normal at-rest position of the drawer locking mechanism is as shown in FIGS. 6 and 10 of the drawings wherein the lock bar 22 which is attached to an adjacent eccentric arm 8 of the lock transfer rod 5 by means of the notch 40 at the upper end of the lock bar will be understood to be in its lowered position, that is, with the lock dog 28 disposed in a horizontal plane corresponding to that of an appropriate striker 41 fixedly carried by the exterior of the adjacent drawer side wall 35 and projecting laterally into the drawer opening 33 a sufficient distance to abut the face member 34 of the lock dog 28 when located as shown in FIGS. 6 and 10 of the drawings. Upon unlocking of the lock assembly 11 and the subsequent retraction of the lock cam 18 and concurrent elevation of all of the crank portion eccentric arms 8 as assisted by the extension spring 20, it will follow that all lock bars 22 engaging any of the crank portions 7 will be concurrently elevated from the position of FIG. 10 to that as shown in FIG. 11 of the drawings, whereupon the respective lock dogs 28 will be likewise elevated to a horizontal plane sufficient to clear the bottom-most portion of the lock dogs 28 above the uppermost portion of the adjacent drawer strikers 41 so that selected drawer fronts 4' may be pulled outwardly without interference from the locking mechanism.

Quite obviously, with the lock assembly 11 in the unlocked or released position of FIG. 8, any extended drawers 4 may be selectively closed or returned fully within their respective drawer opening 33 without any engagement between the paired strikers 41 and lock dogs 28. On the other hand, return of any opened drawer 4 to the closed position is not hampered should an operator depress the lock plunger 16 to the locked position of FIG. 9. Understanding that when the lock cam 18 has depressed its adjacent eccentric arm 8, that all of the other eccentric arms 8 have likewise been displaced downwardly with a corresponding downward movement of the lock bars 22 so that the lock dogs 28 are moved into a horizontal plane similar to that of the drawer strikers 41, it will be observed that upon the subsequent closing of any opened drawers the rear face of the striker 41 will initially engage the forward face of the lock dog ramp 32 and continued closing of the drawer will merely deflect laterally and outwardly the lock dog ramp and face member until the nose of the striker 41 clears the juncture of the lock dog ramp 32 and face member 34, at which time the lock dog will spring back to its normal at-rest position and the components will appear as in FIG. 6 of the drawings.

By providing a length to each eccentric arm 8 sufficient to straddle an intermediate partition 23 and to extend into the two adjacent drawer openings 33 it will be obvious that not only one but two lock bars 22 could engage and be actuated by a single one of the eccentric arms 8. Likewise, the crank position 7 selected to cooperate with the lock assembly 11 may also serve to regulate one or two lock bars such as is shown in the embodiment of FIG. 1. Of course, in the case of a knee-hole desk wherein the lock assembly 11 is positioned in the desk top edge 13 over the knee-hole, then the crank portion 7 cooperating with the lock assembly 11 would not have any drawer lock bars 22 associated therewith.

We claim:

1. A drawer locking mechanism comprising, in combination with an article of furniture having a top and one or more columns of drawers therebeneath, a lock transfer rod disposed within said top, said rod including a plurality of spaced apart congruent crank portions, all disposed in a common plane, said rod having longitudinally aligned axial means connected adjacent each side of each said crank portion, said axial means comprising an axial portion intermediate each pair of adjacent crank portions and an axial arm connected to the distal portion of each end-most crank portion, each said crank portion including an eccentric arm parallel to said axial means and a pair of radial arms joined to adjacent elements of said axial means, means mounting said rod within said top for simultaneous and equal arcuate displacement of all said crank portions about said axial means, each said drawer column provided with a separate vertical lock bar engageable with a selected one of said rod crank portions, cooperating catch means on each said lock bar and drawers engageable when said lock bar is at a first elevation and disposed in different horizontal planes when said lock bar is in a second elevation, a lock assembly in said top including a reciprocating cam engageable with any selected one of said crank portions of said rod whereby, operation of said lock assembly reciprocates said cam to concurrently arcuately displace all said congruent crank portions and vertically displace each said lock bar.

2. A drawer locking mechanism according to claim 1 wherein, said rod mounting means includes bearing clips engaging said axial portions.

3. A drawer locking mechanism according to claim 1 including, spring means normally displacing one said crank portion into constant engagement with said lock assembly cam with concurrent displacement of all remaining said crank portions.

4. A drawer locking mechanism according to claim 1 wherein, said catch means includes a laterally deflectable lock dog mounted on said lock bar adjacent each said drawer and a rigid striker adjacently mounted on each said drawer.

5. A drawer locking mechanism according to claim 3 wherein, said spring means engages the same said crank portion as said lock assembly cam.

6. A drawer locking mechanism according to claim 4 wherein, said lock dog includes a rearwardly directed resilient ramp extending toward said adjacent drawer, and a planar face member at the free end of said ramp horizontally extending normal to the direction of travel of said drawer.

7. A drawer locking mechanism according to claim 6 wherein, said lock dog includes a tab engaging said lock bar, fastening means attaching said tab to said lock bar, said lock bar provided with a cut-out, a tang on said tab disposed within said cut-out to preclude pivotal displacement of said lock dog about said fastening means.

8. A drawer locking mechanism according to claim 6 including, a mounting plate adjacent said drawer and provided with a vertical channel, said lock bar slidably disposed in said channel, said mounting plate provided with an aperture with said face member disposed therethrough, and a foot on the free end of said face member engaging the rear of said mounting plate.

* * * * *